US008590453B2

(12) United States Patent
Bender

(10) Patent No.: US 8,590,453 B2
(45) Date of Patent: Nov. 26, 2013

(54) EXTENDING BOOM FOR STABILIZING PROJECTILES LAUNCHED FROM AN APPARATUS

(75) Inventor: James M. Bender, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 78 days.

(21) Appl. No.: 13/397,030

(22) Filed: Feb. 15, 2012

(65) Prior Publication Data

US 2013/0206029 A1 Aug. 15, 2013

(51) Int. Cl.
*F42B 10/00* (2006.01)

(52) U.S. Cl.
USPC ..... 102/517; 102/520; 102/522; 244/3.3

(58) Field of Classification Search
USPC ..... 102/501, 517, 520, 521, 522; 124/3; 244/3.3
See application file for complete search history.

(56) References Cited

U.S. PATENT DOCUMENTS

| | | | | | |
|---|---|---|---|---|---|
| 656,933 | A | * | 8/1900 | Brown | 244/3.3 |
| 1,278,786 | A | * | 9/1918 | Teleszky | 102/436 |
| 3,292,879 | A | * | 12/1966 | Seward | 244/3.3 |
| 3,842,741 | A | * | 10/1974 | Brothers et al. | 102/490 |
| 4,467,696 | A | * | 8/1984 | McNab et al. | 89/8 |
| H357 | H | * | 11/1987 | Howland et al. | 89/8 |
| 5,483,863 | A | * | 1/1996 | Dreizin | 89/8 |
| 7,036,434 | B1 | * | 5/2006 | Vo et al. | 102/522 |
| 2008/0000380 | A1 | * | 1/2008 | Dryer | 102/520 |
| 2012/0000450 | A1 | * | 1/2012 | Solberg | 124/3 |

* cited by examiner

*Primary Examiner* — Gabriel Klein
(74) *Attorney, Agent, or Firm* — Eric B. Compton

(57) ABSTRACT

A projectile for launch from an apparatus is disclosed herein. In some embodiments, the projectile includes a body; a boom having a first end extendable from the body; and an armature coupled to the first end of the boom, wherein the armature is configured to be moveable along and launchable from the apparatus and the armature is configured to be separable from the first end of the extended boom after launch from the apparatus.

24 Claims, 3 Drawing Sheets

EXTENDING BOOM FOR STABILIZING PROJECTILES LAUNCHED FROM AN APPARATUS

GOVERNMENT INTEREST

Governmental Interest—The invention described herein may be manufactured, used and licensed by or for the U.S. Government.

FIELD OF INVENTION

Embodiments of the present invention generally relate to projectiles and, more particularly, to a projectile for launch from an apparatus.

BACKGROUND OF THE INVENTION

An electromagnetic apparatus, which may be commonly known as a electromagnetic (EM) gun or rail gun, may be used to launch a projectile at a hypervelocity, for example, such as about Mach 3 or greater. Projectiles launched from an electromagnetic apparatus typically have much higher muzzle velocities than from conventional propellant based cannons or guns. For example, a standard 155-mm howitzer using the highest charge can propel projectiles at about Mach 2.6.

Unlike a projectile that may be launched through a rifled barrel of a cannon or the like, a projectile launched from two parallel rails of the electromagnetic apparatus does not spin, and therefore, may require stabilization to ensure that the projectile is accurately delivered to a desired target. Further, because of the high velocities at which the projectile is launched from the electromagnetic apparatus, other common forms of stabilization besides spinning, such as a plurality of fins distributed about the projectile can shear off from the projectile in response to the sudden onset of fluid flow or drag on each fin at the muzzle exit or the electromagnetic apparatus.

BRIEF SUMMARY OF THE INVENTION

Embodiments of a projectile for launch from an apparatus are disclosed herein. In some embodiments, the projectile includes: a body; a boom having a first end extendable from the body; and an armature coupled to the first end of the boom, wherein the armature is configured to be moveable along and launchable from the apparatus and the armature is configured to be separable from the first end of the extended boom after launch from the apparatus.

In other embodiments, the projectile for launch from an electromagnetic apparatus includes a body; a cylinder moveable with respect to the body, wherein a first end of the cylinder is extendable from the body and wherein a second end of the cylinder remains within the body when the cylinder is fully extended and prevents the cylinder from separating from the body; a plurality of fins or a flare cone disposed about the first end of the cylinder; a platform having a first surface coupled to the first end of the cylinder; and a first plate and a second plate disposed on opposing sides of an opposing second surface of the platform and extending from the opposing second surface in the same direction in which the cylinder extends from body, wherein the first plate is configured to contact the upper surfaces of each of the opposing parallel rails of the electromagnetic apparatus and wherein the second plate is configured to contact second surfaces of the opposing parallel rails such that a force formed by the contact of the first and second plates with the first and second surfaces of the parallel rails propels the platform along the parallel rails and wherein the platform is configured to be separable from the first end of the cylinder after the cylinder has fully extended from the body after launch from the electromagnetic apparatus.

In addition, in further embodiments, the projectile for launch from an apparatus includes: a body having a base; a boom, moveable with respect to the body, and having a portion extendable from the base; and a plurality of fins or a flare cone disposed about the portion of the boom, wherein, after the projectile is launched from the apparatus, the plurality of fins or the flare cone stabilize the projectile in flight.

Other and further embodiments of a projectile for launch from an apparatus are discussed below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Embodiments of the present invention relate to a projectile for launch from an apparatus. The projectiles disclosed herein advantageously provide stabilization thereto during flight using an extendable boom that deploys from the body of the projectile after the projectile is launched from the apparatus.

In some embodiments, the apparatus may be an electromagnetic apparatus, such as an EM gun or rail gun, which launches the projectile at hypersonic speed. For instance, "hypersonic" for EM guns is generally defined as speeds over Mach 5. However, it will be appreciated that in other embodiments, the apparatus may be a propellant based cannon, gun, artillery launching apparatus, or the like, which launches the projectile at slower speeds. For instance, an explosive or other propellant inside the projectile or the launching apparatus may generate the force to the launch the projectile. Other projectile launching apparatuses for launching or deploying the projectile which do not use an explosive or propellant might also be used in further embodiments. Depending on particulars of the launching apparatus, a pushing device (such as an armature) that is used to accelerate the projectile in the apparatus may not be necessary.

The projectile may be any flying object that might not be rotated during flight and/or is otherwise unstable during flight. The projectile may be launched in air and/or water. In the description below, a projectile for use with an electromagnetic apparatus is described. It will be appreciated that the disclosure of the projectile for use with the electromagnetic apparatus may be similarly configured for use with other types of launching apparatuses and/or for stabilized flight of the projectile. The projectile could be further spun or rotated for additional stabilization.

In one embodiment, the projectile may be configured to provide the form, fit and function of a M107 155-mm artillery projectile. Of course, the projectile may be configured to provide the form, fit and function of other conventional artillery projectiles also.

Figure 1:
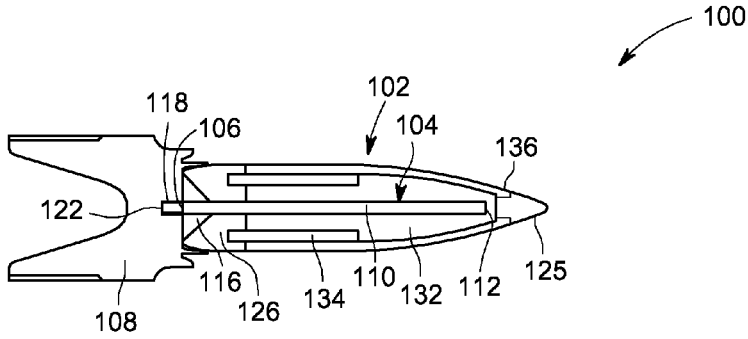
FIG. 1 depicts a projectile in accordance with some embodiments of the present invention.

FIG. 1 depicts a projectile 100 in accordance with some embodiments of the present invention. For example, as illustrated in FIG. 1, the projectile 100 may be in a configuration to be launched from the rails of an electromagnetic apparatus as discussed below and depicted in FIG. 5.

The projectile 100 for use with an electromagnetic apparatus may include a body 102, a boom 104 moveable with respect to the body 102 and having a first end 106 extendable from the body, and an armature 108 coupled to the first end 106 of the boom 104.

A portion of the boom 104 may be deployed from the body 102 after the projectile is launched from the apparatus to provide stabilization to the projectile during flight in multiple ways. In some embodiments, fluid flow relative to a portion of the projectile 100 during flight may cause the boom 104 to extend from the body 102. For instance, drag on the armature 108 of the projectile 100 may cause the first end 106 of the boom 104 to extend from the body 102. Fluid flow relative to other portions of the projectile 100 (such as on exposed portions of fins or a flare cone disposed about the first end 106 of the boom 104) may similarly be used deploy the boom 104 from the body 102. And fluid flow through one or more ports (not shown) into the body 102 of the projectile 102 may likewise be used to deploy the boom 104. It is further feasible that the boom 104 may also be extended during flight using an actuator (e.g., a spring mechanism, a motor, a piston/cylinder unit, solenoid, or the like) provided in the projectile, with or without the aid of fluid flow. The actuator may be activated after a predetermined time, a detected or sensed parameter (such as force or acceleration, speed/velocity, distance, or other flight parameter of the projectile), a control signal, or any combination thereof. For example, a flight controller/processor and one or more sensors (not shown) may be further provided in the projectile 100 for these purposes.

Figure 2:
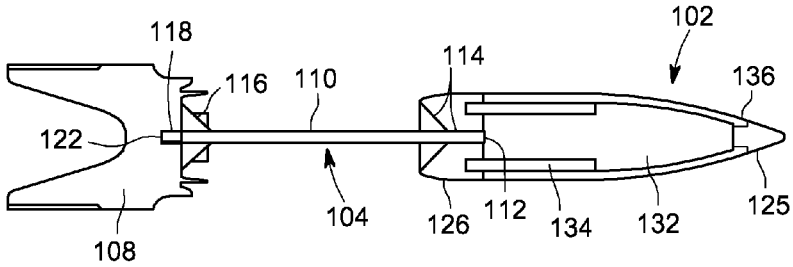
FIG. 2 depicts a projectile in accordance with some embodiments of the present invention.
Figure 3:
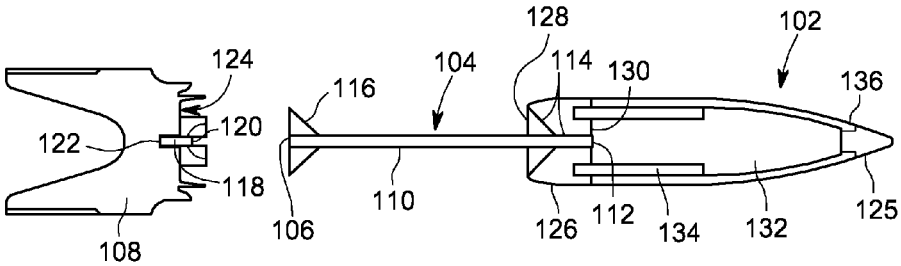
FIG. 3 depicts a projectile in accordance with some embodiments of the present invention.

FIGS. 1-3 illustrate the stages of launch of the projectile 100 according to one embodiment. For example, FIG. 1 illustrates the projectile 100 prior to launch. FIG. 2 illustrates the projectile after launch when drag on the armature 108 causes the first end 106 of the boom 104 to extend from the body 102. FIG. 3 illustrates the projectile 100 after launch when drag on the armature 108 causes the armature 108 to separate from the first end 106 of the boom 104. After separation from the armature 108, the projectile 100 may be in free flight. Other and further embodiments of the projectile are discussed below.

The boom may include a cylinder 110 moveable with respect to the body 102, wherein the first end 106 of the cylinder 110 is extendable from the body 102 and wherein a second end 112 of the cylinder 110 remains within the body 102 when the cylinder 110 is fully extended and prevents the cylinder 110 from decoupling or separating from the body 102 as illustrated in FIG. 2. For example, the second end 112 may have a diameter that is larger than the diameter of an opening 114 in the body 102 through with the cylinder 110 may be movably disposed. Alternatively, other stopping mechanisms, such as cap or the like disposed on the second end 112 to prevent the second end 112 from passing through the opening 114. The cylinder 100 is one exemplary embodiment of the boom 102 and non-circular cross-sections for the boom 102 may be used in some embodiments. The cylinder 100 may be formed of any suitable material, such as one or more of steel, aluminum (Al), or other high strength structural materials. In some embodiments, the cylinder 110 may be solid in cross-section; although, in other embodiments, it may be hollow in cross-section. The cylinder 110 may be a rod in some instances.

A plurality of fins 116 may be disposed about the first end 106 of the boom 104 (e.g., the cylinder 110). The fins 116 may be disposed symmetrically about the cylinder 110. In some embodiments, up to about 6 fins may be used (although it should be appreciated that the number, size, and/or arrangement of the fins may be configured depending on the use of the projectile). As illustrated in FIGS. 1-3, each fin 116 may extend in a radial direction from the cylinder 110; however, each fin 116 may not extend radially beyond the footprint of the body 102 as illustrated. For example, the larger footprint of the body 102 may reduce any drag experienced by the fins 116 during hypervelocity flight (e.g., greater than or equal to 3.5 Mach) and thus may reduce the possibility of the fins 116 shearing off the cylinder 110. In some embodiments, a flare cone may be used in addition to or as an alternative to fins. The flare cone may provide higher drag and be effective for short range applications whereas fins may provide lower drag for an extended range of the projectile in some instances.

As illustrated in FIG. 1, the plurality of fins may be disposed in the opening 114 within the body 102 prior to launch from the electromagnetic apparatus. As illustrated in FIG. 1, the opening 114 may be adapted on the armature-facing side of the body 102 such that the first end 106 of the cylinder 110 and the plurality of fins 116 are at least flush with a surface of the armature-facing side of the body 102 prior to launch (i.e., are flush or disposed within the body 102). The fins 116 may be made from similar materials as discussed above with respect to the cylinder 110. The fins 116 may be formed with the cylinder 110 as a single member, or alternatively may be fastened to the first end 106 of the cylinder 110 by any suitable methods, such as welding or the like.

The first end 106 of the cylinder 110 may be coupled to the armature 108 by a fastening mechanism that is adapted to release and/or break from the first end of the boom 102 (e.g., the cylinder 110) in response to a force caused by drag on the armature 108 when the projectile 100 is launched to separate the armature 108 from the first end 106 of the boom 102 (e.g., the cylinder 110). In some embodiments, the fastening mechanism may include a pin 118 coupling the first end 106 of the boom 102 to the armature 108 as illustrated in FIGS. 1-2. The pin 118 may have a first end 120 coupled to the first end 106 of the cylinder 110 and a second end 122 coupled to a first surface 124 of the armature 108. For example, as illustrated in FIG. 3, the pin 118 may be released from the first end 106 of the cylinder 110 and remain lodged in the armature 108. However, in some embodiments, the pin 118 may be designed so as to break, resulting in a portion of the pin 118 remaining in both the armature 108 and the first end 106 of the boom 102 after separation of the armature 108 from the first end 106.

The body 102 may have any suitable shape consistent with a high velocity or hypervelocity projectile in various embodiments. For example, as illustrated in FIGS. 1-3, the body 102 may have a conical shape with an increasing cross-section from a nose cap 125 to a base 126, or an increasing cross-section from a nose cap 125 to a location disposed between the nose cap 125 and the base 126, with a substantially constant cross-section from the location to the base 126. The base 126 may oppose the armature 108. The opening 114 may be disposed through the base 126 from an armature-facing side 128 of the base 126 to a compartment-facing side 130 of the base 126. The opening 114 may be adapted on the armature-facing side 126 such that the first end 106 of the boom 104 (e.g., the cylinder 110) and the plurality of fins 116 disposed about the first end 106 are at least flush with a surface of the armature-facing side 126 before the boom 104 is extended from the body 102.

A compartment 132 disposed within the body 102 and extending from the base 126 in a second direction opposite a direction which the first end 106 of the boom 104 extends from the body 102. The boom 102 may be movably disposed through the base 126 and the compartment 132 as illustrated in FIGS. 1-3. The compartment 132 may be utilized for holding a payload, such as explosives, a penetrating rod, a shaped-charge, or the like. Projectile 100 thus may be configured as a bomb, a warhead, munitions or the like. In addition, as illustrated in FIGS. 1-3, a ballast weight 134 may be optionally disposed in the compartment 132 to provide additional ballast to the projectile 100 during flight. For example, the ballast weight 134 may comprise any suitable material compatible with any of the aforementioned exemplary payloads.

The nose cap 125 may be coupled to a base-opposing end 136 of the compartment 132 as illustrated in FIGS. 1-3. The nose cap 125 may comprise any suitable material, such as aluminum (Al), steel, or the like. Although illustrated as a separate member in the Figures, it will be appreciated that the nose cap 125 may be integrated with the compartment 132 in some instances. The nose cap 125 may be utilized for any suitable purpose, such as to reduce drag on the projectile 100 while in flight, or for example, as a fuse mechanism by which the payload of the projectile may be detonated on impact with or in proximity to a target.

Figure 4A:
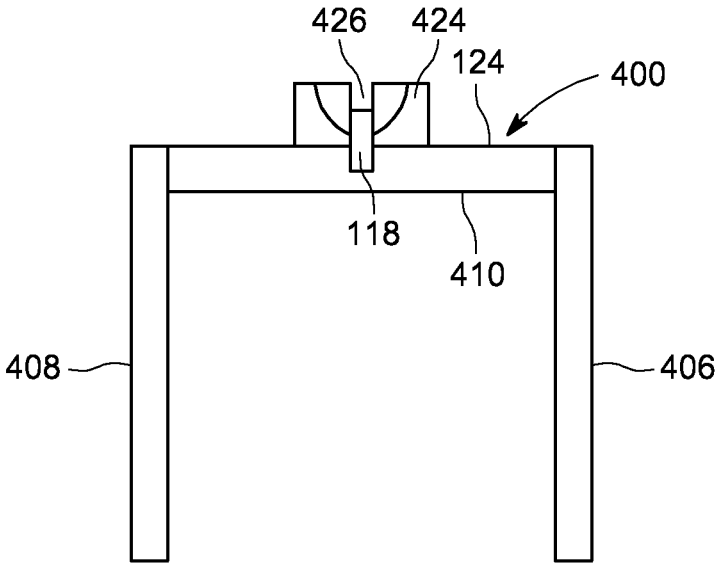
FIGS. 4A-C depict schematic side and end views of an armature in accordance with some embodiments of the present invention.
Figure 4B:
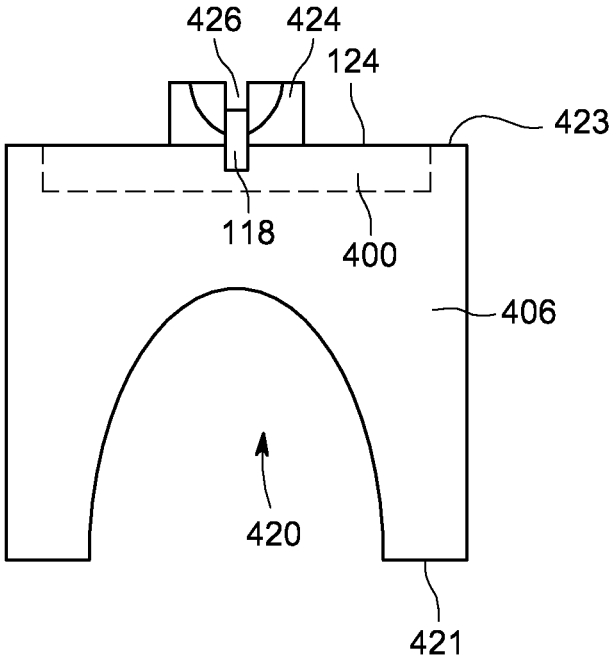
Figure 4C:
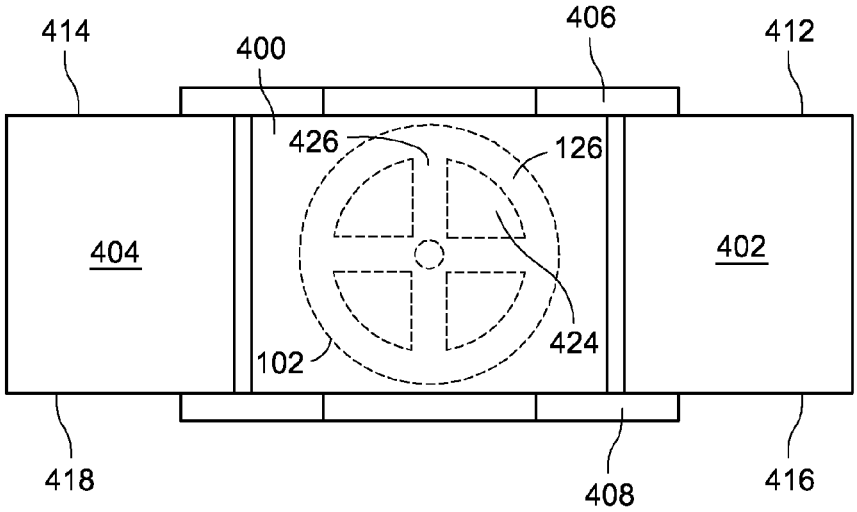

The armature 108 is illustrated in more detail in FIGS. 4A-C in accordance with some embodiments of the present invention. The armature may be configured to be moveable along and launchable, for example, from opposing parallel rails of an electromagnetic apparatus, as discussed below, or from another apparatus, such as a cannon or gun.

The armature 108 may be formed from a single piece of a conductive material, or alternatively, comprise several pieces coupled together by welding or the like. The armature 108 may comprise a conductive material, such as aluminum (Al) or the like to complete an electrical circuit between the opposing rails of an electromagnetic apparatus as discussed below. The armature 108 may include a platform 400 having the first surface 124, which may be coupled to the first end 106 of the boom 104 prior to separation of the armature from the boom 104 and the body 102 after launch of the projectile 100. The platform 400 may have a cross-sectional area that is greater than the maximum cross-sectional area of the body 102 as illustrated in FIG. 4C. For example, the platform 400 may be larger in cross-section such that the body 102 does not touch either of the parallel rails 402, 404 of the electromagnetic apparatus as further illustrated in FIG. 4C. For example, the body 102 may be deliberately non-contacting with the rails 402, 404 to at least limit high currents from travelling through the body 102. For example, such high currents may melt the body under some conditions.

As illustrated in FIGS. 4A-C, the armature 108 includes a first plate 406 and a second plate 408 disposed on an opposing end of the platform 400 from the first plate 406. The first and second plates 406, 408 may extend from an opposing second surface 410 of the platform 400 in the same direction as which the first end 106 of the boom 104 extends from the body 102. As shown in FIG. 4C, the first plate 406 may be configured to contact the upper surfaces 412,414 of each of the opposing parallel rails 402, 404 of the electromagnetic apparatus and wherein the second plate 408 is configured to contact the lower surfaces 416, 418 of the each of the opposing parallel rails 402, 404. The first and second plates 406, 408 may be any suitable shape such that the plates contact the rails 402, 404 as discussed above. For example, as illustrated in FIG. 4B, each plate 406, 408 may have an opening 420 disposed through each plate 406, 408. The opening 420 may have any suitable shape, for example, as illustrated, the opening 420 may be disposed in a central region of the plate 406 and extend through a back end 421 of the plate 406 wherein the back end 421 of the plate 406 opposes a front end 423 of the plate 406 which may be coupled to the platform 400.

As illustrated in FIGS. 2-3, 4A-C, the armature 108 may include a holder 424 extending from the first surface 124 of the platform 400 in a second direction opposing the direction in which the boom 104 extends from the body 102. The holder 424 may be adapted to receive the first end 106 of the boom 104 and adapted to fit into the opening 114 within the body 102 as illustrated in FIG. 2-3. Further, as illustrated in FIG. 4C, the holder 424 may further include a plurality of slots 426, for example, such that each slot 426 is adapted to hold a fin 116.

Figure 5:
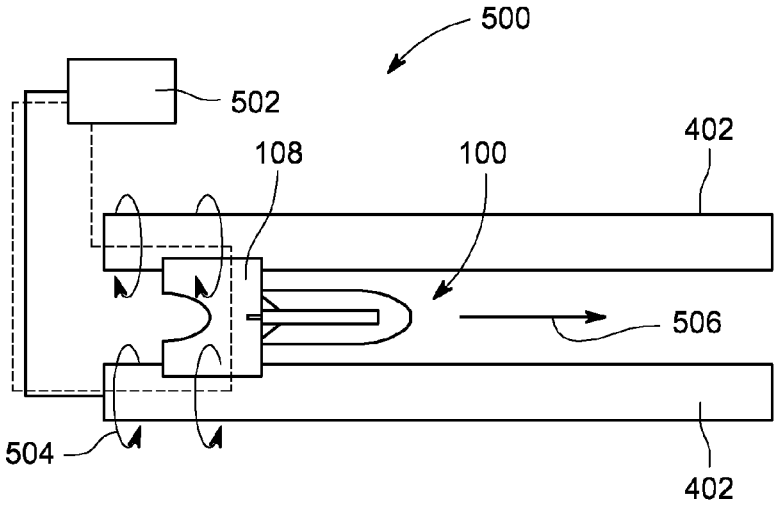
FIG. 5 depicts a schematic view of an exemplary electromagnetic apparatus used to launch a projectile in accordance with some embodiments of the present invention.

An exemplary electromagnetic apparatus 500 is illustrated in FIG. 5 in accordance with some embodiments of the present invention. For example, as illustrated in FIG. 5, the projectile 100 may be configured for launch. The electromagnetic apparatus 500 may include a power source 502 having opposing terminals coupled to the rails 402, 404. In operation, the power source 502 may be used to charge a bank of capacitors (not shown). After the capacitors are fully charged the projectile 100 (e.g., the armature 108) may be brought into contact with the rails 402, 404 as discussed above. The contact of the armature 108 with each of the rails 402, 404 may complete an electrical circuit (illustrated by dotted lines in FIG. 5). The completed electrically circuit allows current to flow between the rails 402, 404 and therefore creates a magnetic field 504 along the rails 402, 404. Once the projectile is in contact with the rails, the circuit may be completed by throwing a switching device (not shown) which discharges the capacitors through the rails 402, 404 providing an electromotive force 506 propelling the projectile 100 forward along the rails 402, 404. The combination of the magnetic field 504, the current, and the lengths of the rails 402, 404 may determine the magnitude of the electromotive force 506 that is provided. The electromotive force 506 may be controlled by altering the magnitude of the current and/or the length of the rails 402, 404.

In accordance with some applications of the invention, fins and/or a flare cone may be further used for increasing the drag of the projectile. In this way, a projectile may also be configured as a drag device such that when the boom is extended from the body and the fins or the flare cone are exposed to fluid flow relative to the projectile, the projectile itself is slowed down, and/or another object connected to the projectile is slowed down. For example, one or more projectiles may be deployed as an emergency drag device to slow down high-speed vehicles, such as watercrafts or racing boats. In such applications, the projectiles may be attached to the vehicle (for instance, via a tether) and may be deployed behind the vehicle in water when it is desired to slow or stop the vehicle. Fluid flowing past the fins or flare cone of the projectile thus creates sufficient drag to sufficiently slow the vehicle.

While the foregoing is directed to embodiments of the present invention, other and further embodiments of the invention may be devised without departing from the basic scope thereof, and the scope thereof is determined by the claims that follow.

The invention claimed is:

1. A projectile for launch from an apparatus, comprising:

a body;

a boom having a first end extendable from the body, the boom being moveable with respect to the body from a retracted position to an extended position; and an armature coupled to the first end of the boom, wherein the armature is configured to be moveable with the boom as the boom extends and launchable from the apparatus, and the armature is configured to be separable from the first end of the boom in the extended position after launch from the apparatus.

2. The projectile of claim 1, wherein the boom comprises:

a cylinder moveable with respect to the body, wherein the first end of the cylinder is extendable from the body and wherein a second end of the cylinder remains within the body when the cylinder is fully extended and prevents the cylinder from separating from the body.

3. The projectile of claim 2, wherein the body further comprises an opening and wherein the second end of the cylinder has a diameter larger than the diameter of the opening that prevents the second end from passing through the opening when the cylinder is fully extended from the body.

4. The projectile of claim 1, the boom further comprising:

a plurality of fins or a flare cone disposed about the first end of the boom.

5. The projectile of claim 4, wherein the plurality of fins or the flare cone are disposed in an opening within the body prior to launch of the projectile from the apparatus.

6. The projectile of claim 1, further comprising:

a pin coupling the first end of the boom to the armature, wherein the pin is adapted to release, break, or both, from the first end of the boom in response to a force caused by drag on the armature when the projectile is launched to separate the armature from the first end of the boom.

7. The projectile of claim 1, wherein the armature comprises a conductive material.

8. The projectile of claim 1, wherein the armature further comprises:

a platform having a first surface coupled to the first end of the boom.

9. The projectile of claim 8, wherein the platform has a cross-sectional area that is greater than the maximum cross-sectional area of the body.

10. The projectile of claim 8, wherein the armature further comprises:

a first plate; and a second plate, wherein the first plate and the second plate are disposed on opposing sides of the platform from the first plate.

11. The projectile of claim 10, wherein the first and second plates extend from a second surface of the platform opposing the first surface of the platform.

12. The projectile of claim 11, wherein the first plate is configured to contact first surfaces of opposing parallel rails of the apparatus and wherein the second plate is configured to contact second surfaces of the opposing parallel rails when the projectile is inside the apparatus such that the armature is moveable along the opposing parallel rails.

13. The projectile of claim 11, further comprising:

a holder extending from the first surface of the platform that is configured to receive the first end of the boom and configured to fit into an opening within the body before the boom is extended from the body.

14. The projectile of claim 1, wherein the body further comprises:

a base opposing the armature;

a compartment disposed within the body; and a nose cap, wherein the boom is movably disposed through the base and/or the compartment.

15. The projectile of claim 14, wherein the base further comprises:

an opening disposed through the base such that a plurality of fins or a flare cone disposed about the first end are at least flush with a surface of the base before the boom is extended from the body.

16. A projectile for launch from an electromagnetic apparatus, comprising:

a body;

a cylinder moveable with respect to the body, wherein a first end of the cylinder is extendable from the body and wherein a second end of the cylinder remains within the body when the cylinder is fully extended and prevents the cylinder from separating from the body;

a plurality of fins or a flare cone disposed about the first end of the cylinder;

a platform having a first surface coupled to the first end of the cylinder; and a first plate and a second plate disposed on opposing sides of an opposing second surface of the platform and extending from the opposing second surface in the same direction in which the cylinder extends from body, wherein the first plate is configured to contact first surfaces of opposing parallel rails of the electromagnetic apparatus and wherein the second plate is configured to contact second surfaces of the opposing parallel rails such that a force formed by the contact of the first and second plates with the first and second surfaces of the parallel rails propels the platform along the parallel rails and wherein the platform is configured to be separable from the first end of the cylinder after the cylinder has fully extended from the body after launch from the electromagnetic apparatus.

17. The projectile of claim 16, wherein the body further comprises:

a base;

a compartment disposed within the body; and a nose cap, wherein the boom is movably disposed through the base and/or the compartment.

18. The projectile of claim 17, wherein the base further comprises:

an opening disposed through the base such that a plurality of fins or a flare cone disposed about the first end are at least flush with a surface of the base before the cylinder is extended from the body.

19. The projectile of claim 16, wherein the platform further comprising:

a holder extending from the first surface of the platform that is configured to receive the first end of the cylinder and configured to fit into an opening within the body.

20. The projectile of claim 16, further comprising:

a pin having a first end coupled to the first end of the cylinder and a second end coupled to the first surface of the platform, wherein the pin is adapted to release, break, or both, from the first end of the cylinder in response to a force caused by drag on the platform after the projectile is launched to separate the platform from the first end of the cylinder.

21. A projectile for launch from an apparatus, comprising:

a body including a base;

a boom, moveable with respect to the body, and having a portion extendable from the base;

a plurality of fins or a flare cone disposed about the extendable portion of the boom;

an armature configured for launching the projectile from the apparatus; and a pin coupling the extendable portion of the boom to the armature, wherein the pin is adapted to release, break, or both, from the extendable portion of the boom in response to a force caused by drag on the armature when the projectile is launched to separate the armature from the boom, wherein, after the projectile is launched from the apparatus, the plurality of fins or the flare cone stabilize the projectile in flight.

22. The projectile of claim 21, wherein the boom comprises a rod.

23. The projectile of claim 21, further comprising:

an opening disposed in the base such that the plurality of fins or the flare cone are at least flush with a surface of the base before the boom is extended from the body.

24. The projectile of claim 21, wherein, after the projectile is launched from the apparatus, (a) fluid flow relative to a portion of the projectile extends the portion of the boom from body; or (b) an actuator extends the portion of the boom from the body.

* * * * *